US005494224A

United States Patent [19]

Hall et al.

[11] Patent Number: 5,494,224

[45] Date of Patent: Feb. 27, 1996

[54] FLOW AREA ARMATURE FOR FUEL INJECTOR

[75] Inventors: Bryan C. Hall; David Wieczorek, both of Newport News; Gordon H. Wyant, Hampton, all of Va.

[73] Assignee: Siemens Automotive L.P., Auburn Hills, Mich.

[21] Appl. No.: 292,457

[22] Filed: Aug. 18, 1994

[51] Int. Cl.[6] ..... F02M 51/00

[52] U.S. Cl. ..... 239/585.5; 251/129.21

[58] Field of Search ..... 239/585.1–585.5; 251/129.21, 129.18, 129.15

[56] References Cited

U.S. PATENT DOCUMENTS

| | | | |
|---|---|---|---|
| 4,575,009 | 3/1986 | Giraudi | 251/129.21 X |
| 4,653,525 | 3/1987 | Young | 251/129.21 X |
| 4,662,567 | 5/1987 | Knapp | 251/129.21 X |
| 4,700,891 | 10/1987 | Hans et al. | 251/129.21 X |
| 5,174,505 | 12/1992 | Shen | 239/585.1 X |
| 5,207,387 | 5/1993 | Bergstrom | 251/129.21 X |
| 5,348,229 | 9/1994 | Wood et al. | 239/585.1 X |
| 5,427,319 | 6/1995 | Bata | 239/585.4 |

*Primary Examiner*—Andres Kashnikow
*Assistant Examiner*—Lesley D. Morris
*Attorney, Agent, or Firm*—Russel C. Wells

[57] ABSTRACT

The armature has a tubular wall bounding a main axial through-hole. The upper axial end has a larger outside diameter than does the lower axial end. A portion of the tubular wall lying between these upper and lower ends has a frustoconical exterior surface. A single through-hole extends through the tubular wall at this frustoconical surface to non-perpendicularly intersect the main axial through-hole. The upper end of a needle valve is inserted into the lower axial end of the main through-hole, and the two parts are joined there by welding and/or crimping. The inserted end of the needle valve does not obstruct the single through-hole extending through the tubular wall so that fuel entering the armature via the open upper end of the main through-hole will change direction to pass out of the armature through the single through-hole in the tubular wall.

7 Claims, 1 Drawing Sheet

FLOW AREA ARMATURE FOR FUEL INJECTOR

FIELD OF THE INVENTION

This invention relates to solenoid operated fuel injectors that are used in fuel injection systems of internal combustion engines.

BACKGROUND AND SUMMARY OF THE INVENTION

In certain solenoid operated fuel injectors the armature is disposed in the internal fuel path through the fuel injector, and the valve element joined to it so that the two form a unitary subassembly. Since the armature forms part of the magnetic circuit, its design must take into account both magnetic circuit and fuel flow restriction considerations, among others. On the other hand, the valve element design must, among various considerations, including fuel flow restriction, also take in account sealing against a hardened valve seat which it repeatedly impacts during operation. Hence the armature and valve element are typically different materials, the former being a relatively magnetically soft, ferromagnetic material and the latter a relatively magnetically hard ferromagnetic material. In efforts to minimize restriction that an armature imposes on fuel flow, armatures have heretofore been designed with internal passages that allow fuel to flow through them and/or external flats or channels that provide greater flow area around the exterior of the armature.

Flow passages in an armature are commonly in the vicinity of the armature to valve element attachment interface. Crimping and/or welding are two processes that have been used to join the valve element to the armature, and they require that certain minimum amounts of material be available at the attachment interface so that the attachment can be successfully accomplished. This tends to compromise the amount of material that can be omitted in order to improve the fuel flow past and/or through the armature. Consequently, prior armature designs employed a number of small holes through the bottom and/or flats or channels on the outside diameter. Such solutions may require multiple machining operations and/or may still not achieve the necessary reduction in restriction that is required to handle relative high flow rates.

The present invention relates to an improved solution that resides in a construction for the armature that is believed to be entirely novel, both per se and in combination with certain associated parts of a fuel injector. The invention still allows crimping and/or welding to be used to join the valve element and the armature, but provides less flow restriction.

Various features, advantages and the inventive aspects will be seen in the ensuing description and claims which are accompanied by drawings that disclose a presently preferred embodiment of the invention according to the best mode contemplated at the present time for carrying out the invention.

DESCRIPTION OF THE PREFERRED EMBODIMENT

Figure 1:
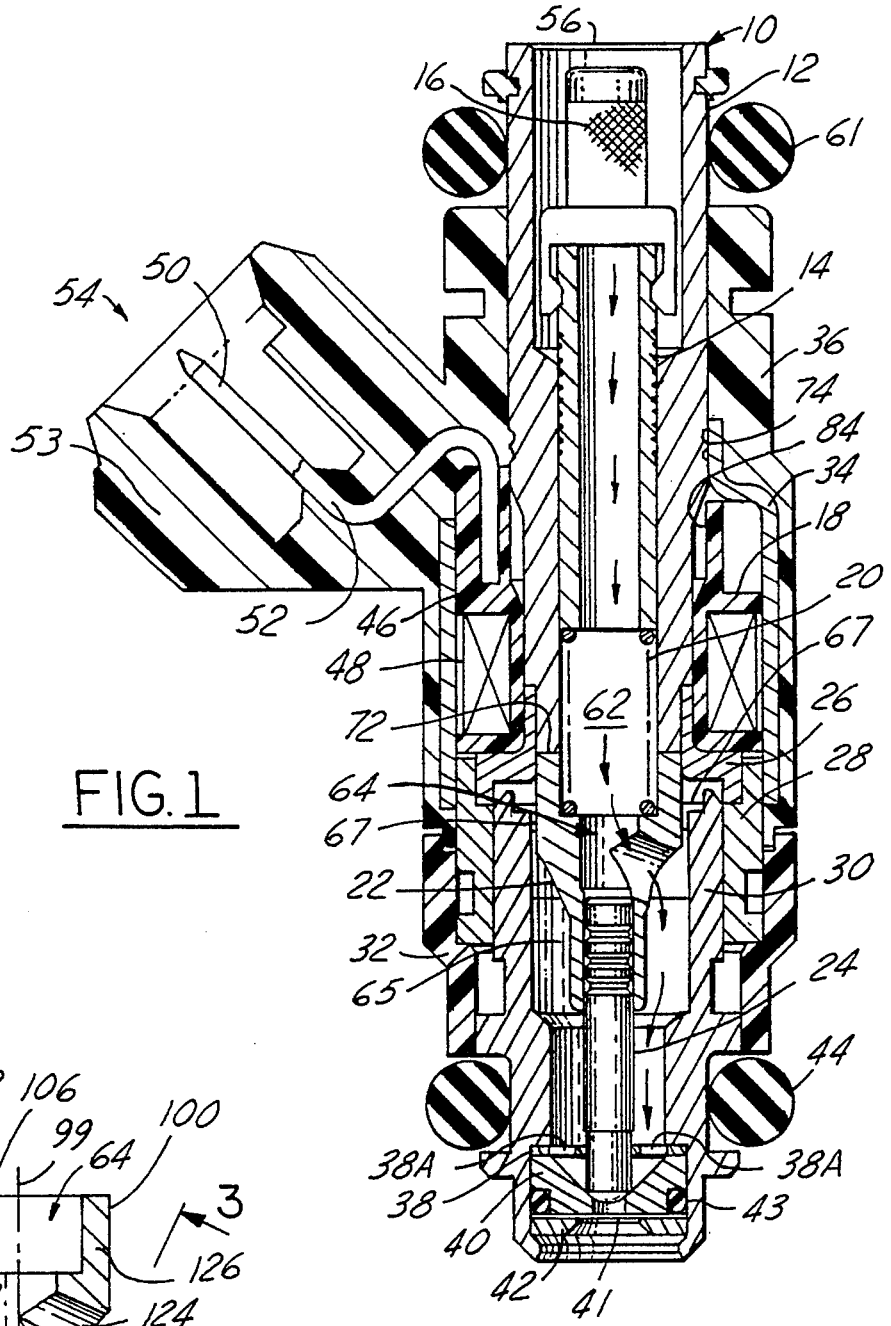
FIG. 1 is a longitudinal cross-sectional view through an exemplary fuel injector embodying principles of the present invention relating to the armature.
Figure 2:
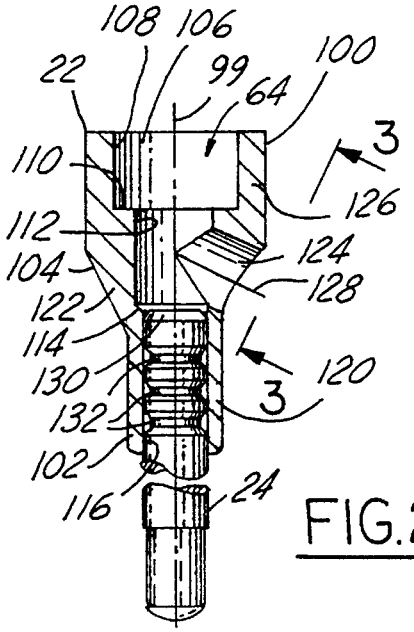
FIG. 2 is an enlarged view of an armature/needle valve assembly of FIG. 1 by themselves, a portion of the needle valve being broken away, and the armature being in cross section.
Figure 3:
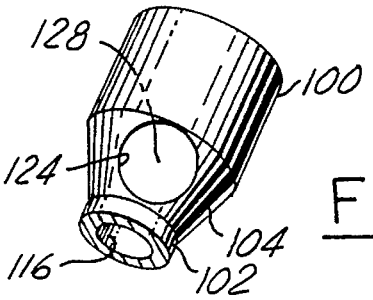
FIG. 3 is a fragmentary view in the direction of arrows 3—3 in FIG. 2.

FIG. 1 shows an exemplary fuel injector 10 comprising a number of parts including a fuel inlet tube 12, an adjustment tube 14, a filter assembly 16, a coil assembly 18, a coil spring 20, an armature 22, a needle valve 24, a non-magnetic shell 26, a valve body shell 28, a valve body 30, a plastic shell 32, a coil assembly housing 34, a non-metallic overmold cover 36, a needle guide member 38, a valve seat member 40, a thin disk orifice member 41, a backup retainer member 42, a small O-ring seal 43, and a large O-ring seal 44.

The needle guide member 38, the valve seat member 40, the thin disk orifice member 41, the backup retainer 42 and the small O-ring seal 43 form a stack that is disposed at the nozzle end of fuel injector 10, as shown in a number of commonly assigned patents, such as U.S. Pat. No. 5,174,505. Armature 22 and needle valve 24 are joined together to form an armature/needle assembly. Before focusing in detail on the inventive features relating to armature 22, further general description of fuel injector 10 will be given.

Coil assembly 18 comprises a plastic bobbin 46 on which an electromagnetic coil 48 is wound. Respective terminations of coil 48 connect to respective terminals 50, 52 that are shaped and, in cooperation with a surround 53 formed as an integral part of cover 36, to form an electrical connector 54 for connecting the fuel injector to an electronic control circuit (not shown) that operates the fuel injector.

Fuel inlet tube 12 is ferromagnetic and comprises a fuel inlet opening 56 at the exposed upper end. An O-ring seal 61 that serves to seal the fuel injector inlet to a cup, or socket, in an associated fuel rail (not shown) is disposed around the inlet end of tube 12. Lower O-ring 44 is for providing a fluid-tight seal with a port in an engine induction intake system (not shown) when the fuel injector is installed on an engine. Filter assembly 16 is fitted to the open upper end of adjustment tube 14 to filter any particulate material larger than a certain size from fuel entering through inlet opening 56 before the fuel enters adjustment tube 14.

In the calibrated fuel injector, adjustment tube 14 has been positioned axially to an axial location within fuel inlet tube 12 that compresses spring 20 to a desired bias force that urges the armature/needle valve assembly such that the rounded tip end of needle valve 24 is seated on valve seat member 40 to close the central hole through the valve seat. Preferably, the adjustable tube 14 and the inlet tube 12 are crimped together to maintain their relative axial positioning after adjustment calibration has been performed.

After entering fuel inlet tube 12 and passing through adjustment tube 14, fuel enters a space 62 that is cooperatively defined by confronting ends of inlet tube 12 and armature 22 and that contains spring 20. Armature 22 comprises a passageway, 64 that communicates space 62 with a passageway 65 in valve body 30, and guide member 38 contains fuel passage holes 38A. This action allows fuel to flow from space 62, through passageways 64, 65 to valve seat member 40. This fuel flow path is indicated by the succession of arrows in FIG. 1.

The upper end of non-ferromagnetic shell 26 is telescopically fitted on and joined to the lower end of inlet tube 12, preferably by laser welding. Valve body shell 28 is ferromagnetic and its upper end is joined in fluid-tight manner to the lower end of non-ferromagnetic shell 26, preferably by laser welding.

The upper end of valve body 30 fits closely inside the lower end of valve body shell 28 and both are joined together in fluid-tight manner, preferably by laser welding. Armature 22 is guided for axial reciprocation by means on the inside wall structure of the fuel injector, specifically by the I.D. of an eyelet 67 that is attached to the upper end of valve body 30. Further guidance of needle valve 24 is by a central guide hole in member 38 through which needle valve 24 passes.

In the closed position shown in FIG. 1, a small working gap 72 exists between fuel inlet tube 12 and armature 22. Coil housing 34 and tube 12 are in contact at 74 and constitute a stator structure that is associated with coil assembly 18. Non-ferromagnetic shell 26 assures that when coil 48 is energized, the magnetic flux will follow a path that includes armature 22. Starting at the lower axial end of housing 34, the magnetic circuit extends through valve body shell 28 and valve body 30 across eyelet 67 to armature 22, and from armature 22 across working gap 72 to inlet tube 12, and back to housing 34. When coil 48 is energized, the spring force on armature 22 is overcome and the armature is attracted toward inlet tube 12 reducing working gap 72. This unseats needle valve 24 from seat member 40 to open the fuel injector so fuel is now injected into the engine induction intake system from the injector's nozzle. When the coil ceases to be energized, spring 20 pushes the armature/needle closed on seat member 40.

Bobbin 46 comprises a central through-hole 84 whose upper portion has a larger diameter than its lower portion to provide for the lower end of tube 12 (whose lower portion has a smaller O.D. than its upper portion) to be inserted into the upper end of through-hole 84 when coil assembly 18 is being assembled to inlet tube 12 during that portion of the fabrication process that creates an assembly that is sometimes referred to as a power group. The tube is inserted to an extent that allows its lower end to protrude from the lower end of through-hole 84 so that shell 26 can be welded to the lower end of tube 12. After that, coil assembly 18 is slid down tube 12 to assume the position in FIG. 1, which is its final position. During this time, terminals 50, 52 are straight and parallel with tube 12, having not yet been formed to their final shapes shown in FIG. 1. Coil assembly 18 is kept in this final position by placing housing 34 over the parts as they appear in FIG. 1 and welding it in place as at 74 for example. As can be seen in FIG. 1, the upper end of housing 34 is shaped to axially trap coil assembly 18 against a shoulder of shell 26. The power group is thereafter completed by further assembly process steps, including steps relating to forming terminals 50, 52 to final shape, and injection molding overmold cover 36. The finished power group includes fuel inlet tube 12, coil assembly 18, non-magnetic shell 26, and valve body shell 28. Valve body 30 and parts associated with it constitute what is sometimes called a valve group, and final assembly of the fuel injector comprises assembling the valve group and the power group together, with the various internal parts such as spring 20, armature 22 and needle valve 24 being contained internally within the two assembled groups.

Attention is now directed to details of armature 22 and its association with related parts of fuel injector 10. Armature 22 is fabricated from a suitable ferromagnetic material and has a generally tubular-walled shape having a longitudinal axis 99 that is coaxial with the axis of reciprocation of the armature/needle valve assembly. The exterior of armature 22 may be described as comprising at its lengthwise end that is disposed toward inlet tube 12 in the assembled fuel injector, a circular cylindrical larger O.D. surface 100 having a certain axial length, and at the opposite lengthwise end, a circular cylindrical smaller O.D. surface 102 having a certain axial length. These two surfaces 100, 102 are coaxial with axis 99 and joined by an intermediate frustoconical surface 104 having a certain axial length.

The interior of armature 22 comprises a through-hole 106 that is coaxial with axis 99 and comprises a larger circular I.D. surface 108 extending inwardly from the end that is toward inlet tube 12 in the assembled fuel injector, to a shoulder 110 that is perpendicular to axis 99. From shoulder 110, through-hole 106 continues as an intermediate circular I.D. surface 112 to a frustoconical shoulder 114. From shoulder 114, through-hole 106 continues to the end of the armature as a smaller circular I.D. surface 116.

Surface 116 has an axial length just slightly longer than that of surface 102 along for the full axial length of the latter, the armature has a circular cylindrical wall portion 120 that is of uniform radial thickness. That portion of the armature wall that is generally between shoulders 110 and 114 is designated by the numeral 122 and for the most part it is not of generally uniform thickness. It is this portion 122 of the armature wall that contains a single circular through-hole 124 extending through the armature wall. That portion of the armature wall that is axially co-extensive with surface 108 and is designated by the reference numeral 126 has uniform radial thickness, somewhat thicker than that of wall portion 120.

Through-hole 124 comprises an axis 128 that transversely intersects axis 99, but not perpendicularly; rather the two are at an obtuse angle in the direction of fuel flow through the armature. The axis 128 is also generally perpendicular to an element of the frustoconical surface 104 and passes through the axis 99 of the armature. The diameter of through-hole 124 is such that it does not intersect either the shoulder 110 or the wall portion 126 of the armature but the exiting portion of the diameter on the surface 104 is lower than the entrance diameter to the smaller circular I.D. surface 116. Thus shoulder 110 and wall portion 126 are each circumferentially uninterrupted, and they also form a seat for the lower end of spring 20 which fits with close conformity therein such that the portion of through-hole 106 formed by surface 112 forms a continuation of the cylindrical void that is bounded by the convolutions of spring 20. The diameter of through-hole 124 is substantially equal to the I.D. of surface 112 so that there is no constriction or splitting of the flow as it passes through the armature, but only a change in direction. The annular area between armature 22 and the passage 65 of valve body 30 that is available for flow exiting through-hole 124 is at least as large as the area of through-hole 124 so that this annular area imposes no constriction on the flow coming out of the armature. Surface 100 also sufficiently axially overlaps ferromagnetic valve body 30 that it imposes no significant increase in reluctance of the fuel injector's magnetic circuit at their interface, and the portion of the armature that is between shoulder 110 and the upper axial end of the armature provides the principal path through the armature for magnetic flux issued by the electromagnetic coil.

One end portion of needle valve 24 that is inserted into I.D. 116 of through-hole 106 has a close diametrical fit therein and sufficient insertion length that the two coaxially align to the required degree and can be joined and maintained in that alignment by a joining operation such as crimping and/or welding. This inserted end portion of needle valve 24 comprises a lead 130 and several spaced apart, parallel circumferential grooves 132 that facilitate the assembly and joining process. The extent of the needle valve's insertion into the armature does not obstruct through-hole 124.

While a presently preferred embodiment of the invention has been illustrated and described, it is to be appreciated that principles of the invention apply to all equivalent constructions that fall within the scope of the following claims. For example, a ball, instead of a needle could be employed as the valve element in certain fuel injectors.

What is claimed is:

1. An armature for an electrically operated fuel injector for injecting fuel into an internal combustion engine the fuel injector having a fuel inlet, a nozzle having a valve seat via which fuel is injected into the engine from the injector, an internal passage within the injector for conveying fuel that has entered the fuel inlet to the nozzle, and a solenoid-operated valve mechanism for selectively opening and closing the valve seat, the mechanism having an armature and a valve element joined together for axial reciprocal movement within the internal passage, and an electromagnetic coil operative to open and close the valve seat in accordance with selective energizing of the electromagnetic coil, and a spring biasing the valve element closing the valve seat, the armature comprising:

an elongated member having a first axially extending section with a first outside diameter at one end, a second axially extending section with a second outside diameter at the opposite end and a third axially extending frustoconical section connecting said first and second sections;

a stepped passageway extending from the internal passage and extending the length of said elongated member, said stepped through-hole having a first counterbore axially extending a distance less than the axial length of said first section, a second counterbore extending from said opposite end of said tubular member a distance into said frustoconical section and a third counterbore interconnecting said first and second counterbores;

said second counterbore having an internal diameter that is smaller than said third counterbore which has an internal diameter that is smaller than said first counterbore;

a shoulder formed at the junction of said first and third counterbores for seating the spring, and a single additional through-hole having an axis normal to an element of a surface of said frustoconical section extending into said third counterbore, said through-hole having its circumferential periphery on the surface of said frustoconical section with a portion of said periphery axially below the junction between said second and third counterbores;

whereby fuel flows from the fuel inlet through said internal passage and through said first counterbore into said second counterbore and said additional through-hole of said armature to the nozzle.

2. An armature for an electrically operated fuel injector as set forth in claim 1 wherein the spring comprises a helical coil spring, and said first counterbore receives said spring with close conformity therein such that said first counterbore and said spring forms a fuel passage that is bounded by convolutions of said spring.

3. An armature for an electrically operated fuel injector as set forth in claim 1 wherein the valve element is located and secured in said second counterbore and does not obstruct said single additional through-hole.

4. An armature for an electrically operated fuel injector as set forth in claim 1 wherein said single additional through-hole has a diameter almost as great as the axially extending surface length of said frustoconical surface.

5. An armature for an electrically operated fuel injector as set forth in claim 4 wherein said single additional through-hole does not intersect said shoulder or said first counterbore of said armature.

6. An armature for an electrically operated fuel injector as set forth in claim 4 wherein said single additional through-hole has a diameter so that there is no significant constriction of the fuel flow as it passes through the armature, but only a change in direction.

7. An armature for an electrically operated fuel injector as set forth in claim 1 wherein that portion of said elongated member between said shoulder and said one end of said armature provides the principal path through said armature for magnetic flux issued by the electromagnetic coil.

* * * * *